US008159156B2

(12) United States Patent
Henig et al.

(10) Patent No.: US 8,159,156 B2
(45) Date of Patent: Apr. 17, 2012

(54) LIGHTING SYSTEMS AND METHODS OF AUTO-COMMISSIONING

(75) Inventors: Robert Henig, Palo Alto, CA (US); David Fowler, Union City, CA (US); Jeremy Stieglitz, Menlo Park, CA (US); David Leonard, Danville, CA (US); Mark Covaro, Sonoma, CA (US)

(73) Assignee: Redwood Systems, Inc., Fremont, CA (US)

( * ) Notice: Subject to any disclaimer, the term of this patent is extended or adjusted under 35 U.S.C. 154(b) by 452 days.

(21) Appl. No.: 12/538,806

(22) Filed: Aug. 10, 2009

(65) Prior Publication Data

US 2011/0031897 A1 Feb. 10, 2011

(51) Int. Cl.
*H05B 37/02* (2006.01)
*H05B 39/00* (2006.01)

(52) U.S. Cl. ..... 315/363; 315/294; 315/312; 315/360; 315/297; 340/12.5

(58) Field of Classification Search ..... 315/363, 315/294, 312, 360, 152, 297, 318; 340/12.5, 340/539.1
See application file for complete search history.

(56) References Cited

U.S. PATENT DOCUMENTS

| | | | | |
|---|---|---|---|---|
| 4,532,713 | A | 8/1985 | Feichtinger | 33/559 |
| 4,914,284 | A | 4/1990 | Halldorsson et al. | 250/206.2 |
| 5,187,655 | A | 2/1993 | Post et al. | 364/146 |
| 5,281,807 | A | 1/1994 | Poisel et al. | 250/216 |
| 5,319,188 | A | 6/1994 | Cole | 250/206.2 |
| 5,448,359 | A | 9/1995 | Schick et al. | 356/375 |
| 5,587,580 | A | 12/1996 | Venier et al. | 250/206.1 |
| 5,662,411 | A | 9/1997 | Haslam et al. | 362/276 |
| 6,046,550 | A | 4/2000 | Ference et al. | 315/291 |
| 6,230,137 | B1 | 5/2001 | Has et al. | 704/275 |
| 6,266,136 | B1 | 7/2001 | Ramer et al. | 356/139.03 |
| 6,846,116 | B2 | 1/2005 | Oka et al. | 385/92 |
| 6,987,571 | B2 | 1/2006 | Yamakawa et al. | 356/600 |
| 7,190,126 | B1 | 3/2007 | Paton | 315/308 |
| 7,342,671 | B2 | 3/2008 | Ito | 356/616 |
| 7,924,415 | B2 | 4/2011 | Leviton | 356/139.02 |
| 2003/0015302 | A1 | 1/2003 | Pessina et al. | 160/331 |

(Continued)

FOREIGN PATENT DOCUMENTS

DE 202 08 061 U1 9/2002

(Continued)

OTHER PUBLICATIONS

Starsense Brochure, dated 2008, pp. 1-7, Philips Lighting B.V., The Netherlands, available at http://www.philips.com/starsense.

(Continued)

*Primary Examiner* — Daniel D Chang
(74) *Attorney, Agent, or Firm* — Brinks Hofer Gilson & Lione

(57) ABSTRACT

A lighting system for areal illumination is disclosed which includes a remote driver and a plurality of fixtures including luminaires, control devices, and/or standalone sensors. A method of commissioning a lighting system is also disclosed which includes causing a light source co-located with each luminaire to emit a signal, detecting the signal at light sensors co-located with each luminaire, converting the signals obtained by the light sensors into distance measurements between luminaires, creating a map recording the relative location of luminaires, and assigning luminaires to groups based on their relative locations in the map. A movable orb region containing luminaires can also be defined.

17 Claims, 4 Drawing Sheets

U.S. PATENT DOCUMENTS

| | | | | |
|---|---|---|---|---|
| 2003/0057887 | A1 | 3/2003 | Dowling et al. | 315/291 |
| 2003/0107888 | A1 | 6/2003 | Devlin et al. | 362/233 |
| 2003/0210167 | A1 | 11/2003 | Weng | 341/176 |
| 2005/0025480 | A1 | 2/2005 | Yeh | 398/12 |
| 2005/0097162 | A1 | 5/2005 | Budike | 709/201 |
| 2006/0202851 | A1 | 9/2006 | Cash et al. | 340/825.69 |
| 2007/0273307 | A1* | 11/2007 | Westrick et al. | 315/312 |
| 2008/0088435 | A1 | 4/2008 | Cash et al. | 340/539.11 |
| 2008/0186720 | A1 | 8/2008 | Verbrugh | 362/383 |
| 2008/0218087 | A1 | 9/2008 | Crouse et al. | 315/131 |
| 2008/0218334 | A1* | 9/2008 | Pitchers et al. | 340/539.1 |
| 2008/0265802 | A1 | 10/2008 | Van de Sluis et al. | 315/297 |
| 2008/0297068 | A1 | 12/2008 | Koren et al. | 315/297 |
| 2009/0033460 | A1 | 2/2009 | Mack et al. | 340/5.71 |
| 2009/0045971 | A1 | 2/2009 | Simons et al. | 340/825.52 |
| 2009/0086487 | A1 | 4/2009 | Ruud et al. | 362/249.02 |
| 2009/0087134 | A1 | 4/2009 | Martinez | 385/12 |
| 2009/0218951 | A1 | 9/2009 | Weaver | 315/154 |
| 2009/0230894 | A1 | 9/2009 | De Goederen et al. | 315/314 |
| 2009/0236910 | A1 | 9/2009 | Yamada et al. | 307/40 |
| 2009/0273433 | A1 | 11/2009 | Rigatti et al. | 340/3.5 |
| 2010/0188009 | A1 | 7/2010 | Bull | 315/246 |
| 2010/0283605 | A1 | 11/2010 | Nevins | 340/540 |
| 2011/0140832 | A1 | 6/2011 | Vinkenvleugel et al. | 340/4.2 |
| 2011/0175533 | A1 | 7/2011 | Holman et al. | 315/130 |
| 2011/0199004 | A1 | 8/2011 | Henig et al. | 315/152 |
| 2011/0199020 | A1 | 8/2011 | Henig et al. | 315/294 |
| 2011/0202151 | A1 | 8/2011 | Covaro et al. | 700/90 |
| 2011/0234366 | A1 | 9/2011 | Feng et al. | 340/3.1 |

FOREIGN PATENT DOCUMENTS

| | | | |
|---|---|---|---|
| EP | 0 481 387 | B1 | 1/1996 |
| WO | WO 03/078894 | A1 | 9/2003 |
| WO | WO 2006/048916 | A2 | 5/2006 |
| WO | WO 2006/095316 | A1 | 9/2006 |
| WO | WO 2006/099422 | A2 | 9/2006 |
| WO | WO 2007/132382 | A2 | 11/2007 |
| WO | W02007138494 | A1 | 12/2007 |
| WO | WO 2009/150581 | A1 | 12/2009 |
| WO | WO 2010/146446 | A1 | 12/2010 |

OTHER PUBLICATIONS

Application Note #138, "Control of LED Lighting", dated Sep. 2007, pp. 1-8, Lutron Electronics Co., Inc., Coopersburg, PA, available at www.lutron.com.

Digital Addressable Lighting Interface, downloaded Aug. 10, 2009, pp. 1-2, Answers.com, available at http://www.answers.com.

U.S. Appl. No. 13/403,544, filed Feb. 23, 2012, Barrilleaux.

* cited by examiner

LIGHTING SYSTEMS AND METHODS OF AUTO-COMMISSIONING

FIELD OF THE INVENTION

One or more embodiments of the present invention relate to lighting systems, methods for automatically mapping the arrangement of a set of luminaires in a lighting system to create functional groups, and methods of setting light levels for individual luminaires.

BACKGROUND

Lighting systems for areal illumination typically comprise (1) a set of "luminaires" (light fixtures comprising mounting hardware and one or more light-emitting elements such as incandescent or fluorescent bulbs or arrays of light-emitting diodes [LEDs]), together with (2) one or more sensor elements (motion sensors, light sensors, and the like), (3) control devices (such as dimmers and switches), and (4) power drivers to set the output light level of each luminaire as a function of sensor outputs and control device settings. Such systems can range in complexity from a single wall switch and bulb to commercial building lighting systems comprising hundreds of luminaires, sensors, and control devices.

A common way to specify, configure, and install such systems requires the use of discrete components, where each of the above elements are purchased separately, and the control logic is implemented by the way the components are connected together using wired or wireless connections. Where convenient, certain elements can be physically grouped. For example, an outdoor security light fixture can have a motion sensor built into the fixture, or a table lamp can have an on/off switch built in. Often, however, such combinations are not used, and each element is separately purchased, installed, and wired together in order to create functional groups.

As the total number of components increases, there can be a need for more sophisticated control systems. These are typically implemented using electronic control systems, which can be implemented using either custom electronics or software running on a more general-purpose control device such as a digital computer. Such systems require a trained engineer to manually connect all devices, describe the system to the control hardware and software, and to define the control functions to be implemented.

A number of standards have been developed for such control systems. A commonly used standard is the Digital Addressable Light Interface (DALI) which is described in Appendix E of IEC60929, a standard for fluorescent lamp ballast control managed by the International Electrotechnical Commission. DALI uses bidirectional data exchange with each luminaire, and a DALI controller can query and set the status of each luminaire. As an example of the kind of control functionality that can be implemented using DALI, an engineer can define groups that associate a set of luminaires with a set of one or more motion sensors, dimmers, and/or switches, all of which have been connected to the control system. While installations complying with the DALI standard are significantly more flexible and easier to reconfigure than a completely hard-wired installation, the process of commissioning a complete lighting system still requires a skilled engineer to define the groups in accordance with the physical installation and further to define the control logic to be implemented.

The cost of discrete components as well as the cost of installation and programming labor have thus far inhibited wide-spread adoption of sophisticated control systems. There are, nevertheless, obvious cost savings and performance benefits that can be realized by intelligently managing the on-time and on-intensity of each light source within lighting systems. Potential saving in electricity usage can be large, and safety and security can be enhanced. Nevertheless, to be widely adopted, the components need to be inexpensive, and the installation should be quick and easy and all configuration work should be possible within the skill range of an average commercial electrician or that of building maintenance personnel.

In order to reduce installation and commissioning costs as well as the skill level required to implement these tasks, it is possible to automate some of the commissioning steps. For example, U.S. Patent Application 2009/0045971 A1 describes estimating the distance between pairs of luminaires using either received signal strength or time-of-flight of a radio-frequency communication signal used to communicate between luminaires.

SUMMARY OF THE INVENTION

A lighting system for areal illumination is disclosed which includes a remote driver and a plurality of fixtures including luminaires, control devices, and/or standalone sensors. The luminaires include a light source whose output light level can be adjusted, a light sensor co-located therewith adapted to measure light received from adjacent fixtures, and a microcontroller capable of transmitting the output of the light sensor over wires to the remote driver. The remote driver is capable of bidirectional communication with the luminaires and provides independently controllable power for the light sources of the luminaires. A method of commissioning a lighting system is also disclosed which includes installing a plurality of luminaires above the area to be illuminated, causing a light source co-located with each luminaire to emit a signal, detecting the signal at light sensors co-located with each luminaire, converting the signals obtained by the light sensors into distance measurements between luminaires, creating a map recording the relative location of luminaires, and assigning luminaires to groups based on their relative locations in the map. A movable orb region large enough to contain a plurality of luminaires can also be defined and the light levels of individual luminaires can be set according to a defined mathematical function of their location within the orb region, where the defined mathematical function sets light levels which vary from the center to the periphery of said orb region.

DETAILED DESCRIPTION

Before the present invention is described in detail, it is to be understood that unless otherwise indicated this invention is not limited to specific construction materials, electronic components, or the like, as such may vary. It is also to be understood that the terminology used herein is for the purpose of describing particular embodiments only and is not intended to limit the scope of the present invention.

It must be noted that as used herein and in the claims, the singular forms "a," "and" and "the" include plural referents unless the context clearly dictates otherwise. Thus, for example, reference to "a fixture" includes two or more fixtures; reference to "a sensor" includes two or more sensors, and so forth.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

Embodiments of the present invention can be used with various supersets and subsets of the exemplary components described herein. For concreteness, embodiments of the invention will be described in the context of a commercial building illumination system comprising a set of LED luminaires, but the invention is not limited to the use of LEDs as light sources nor to use in illuminating buildings.

Generally, a "lighting system" according to one or more embodiments of the present invention comprises a set of "fixtures," and at least one remote driver which collects information from a set of sensor and controls and sets the output light level for each light source which may vary from zero to maximum (a non-zero light level that is limited by a maximum sustainable operating point for the light source). As used herein, a "fixture" can be a luminaires, or a standalone control or sensor; a "luminaire" is a light fixture including a light source plus suitable mounting hardware and decorative trim. In particular embodiments of the present invention, luminaires can further include light sensors designed to sense light from the light sources of adjacent luminaires (either via direct transmission or via reflection from the area under illumination) and additional signal sources and matching sensors using other wavelengths of light or other signal source/sensor technologies.

Figure 1:
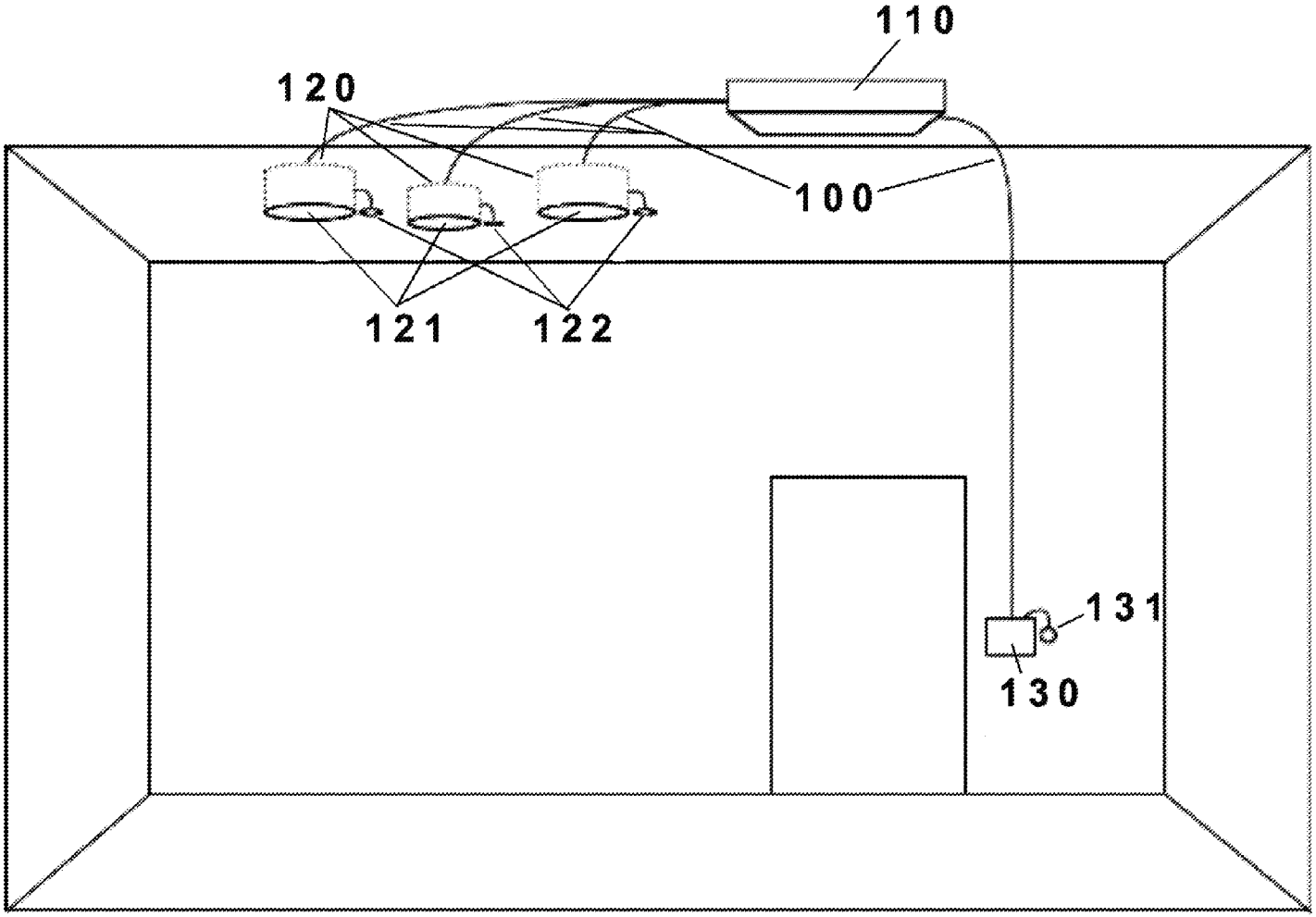
FIG. 1 shows an example configuration of fixtures and a remote driver according to one embodiment of the present invention.

The lighting system further comprises communications means to allow each fixture to communicate with the control system. Such means can include direct wired connections, or any other known communications means such as optical fibers, wireless (radio frequency), ultrasonic, infrared, etc. An example system is illustrated in FIG. 1. A single room is shown. All fixtures are connected by wires 100 to remote driver 110 which is shown located above the ceiling, but can also be located in any other convenient utility location such as a closet or utility shaft, and can be located outside the room. Three luminaires 120 are shown each comprising a light source 121 and light sensors 122. The example system further comprises a wall controller 130 (a dimmer or switch) co-located with an additional light sensor 131.

In accordance with one or more embodiments of the present invention, each luminaire is co-located with at least one sensor and one signal source. The luminaire's light source (for example, a set of LEDs capable of emitting visible white light or a facsimile thereof) can serve as the signal source. As used herein, the term "light source" is to be construed narrowly to encompass sources emitting predominantly visible light unless specifically identified otherwise (as, for example, "infrared light source"). The term "radio frequency" is to be construed herein to describe electromagnetic waves from about 100 kHz to 10 GHz. Such waves do not include infrared, visible, or ultraviolet light.

In certain embodiments, additional signal sources using various technologies such as radio frequency antennas; infrared, ultraviolet, or visible light sources; or ultrasonic emitters can also be provided. Such additional signal sources can provide means for measuring a variety of quantities useful for providing input to a lighting control system. Such quantities include motion, daylight, equipment-on status, presence of people, sound and noise, and the like. Sensors capable of receiving signals from the signal source(s) are also provided. For example, if the luminaire light source is the sole signal source provided, then an optical sensor such as a photodiode, phototransistor, or photoresistor built into the luminaire can be used as a suitable sensor. As another example, if an ultrasonic emitter is built into each luminaire, then an ultrasonic detector can be built into each luminaire to receive and detect the emitted ultrasonic signals. Further, each luminaire is associated with a microcontroller which serves as a luminaire controller. The microcontroller is capable of transmitting the output of sensors to a "remote driver" (described below). In certain embodiments, the microcontroller is also capable of controlling one or more of the installed signal sources, although typically it is not capable of directly controlling the power to the luminaire's main light source which is controlled instead by the remote driver. Microcontrollers can be dedicated to single luminaires or shared among two or more fixtures.

In accordance with one or more embodiments of the present invention, a set of two or more luminaires are installed in close enough proximity and with sufficiently little intervening obstruction such that the sensor(s) co-located with one luminaire can detect signals emitted by the signal source of at least one neighboring luminaire. In a typical workspace illumination application, such neighboring luminaires capable of sensing each other are mounted in a common plane forming the "ceiling" of a particular room in the workspace. Such a plane will typically coincide with a "drop ceiling" located some distance below the physical top of the room, for a typical commercial floor space, but it may vary according to the local architectural structure. Further, there may be a plurality of distinct planes such as where ceiling heights vary, installations include multiple floors, or there are sloping ceilings, for example, above stairways. Sensors co-located with luminaires located in one room or on one floor may be incapable of detecting signals from sources co-located with luminaires in other rooms or on other floors, but are typically able to detect signals from at least some neighboring sources in their immediate vicinity.

Depending on the installed geometry of signal sources and sensors, it can be possible for sensors to receive signals that are propagated by direct line-of-sight, by reflection from workspace surfaces, or a combination thereof. For example, if the luminaire design is such that all components are recessed into the ceiling, then sensors may only be able to receive a reflected signal. Luminaires which comprise protruding elements can be designed to provide direct line-of-sight signals to neighboring fixtures. Such direct line-of-sight signals can be emitted by either the primary light source of the luminaire if that light source protrudes below the ceiling, or it can be provided by an auxiliary signal source such as an infrared LED whose emitting surface protrudes below the ceiling.

In accordance with one or more embodiments of the present invention, each luminaire can comprise a set of two or more LEDs wired together in series and/or in parallel. LEDs suitable for general purpose illumination are now commercially available, and are becoming cost and performance (in terms of lighting efficiency) competitive with fluorescent lighting. The series and parallel wiring can be arranged so that the combined set of LEDs can be powered by any convenient and available combination of voltage and current. For example, standard ac power at 120 V, 240 V, or other locally available voltage can be rectified and used without voltage conversion.

In accordance with one or more embodiments of the present invention, a set of LEDs can be wired to operate at less than 60 V. In such a case, each luminaire can be connected to the remote driver via low voltage wiring such as lamp cord or the twisted pair wiring commonly used for data and voice communication. Such wire is permitted by most electric codes for use at voltages up to 60 V. Depending on the wire gauge, a limit on the current-carrying capacity of each wire is also provided according to the voltage drop (and wiring power loss) deemed to be acceptable. For example, a common wire standard widely used in data communications (for example, for Ethernet networks) is CAT-5, which comprises four twisted pairs of 24-gauge insulated copper wire. Each twisted pair can reasonably deliver 350 mA dc. The resistance of 24-gauge wire is 0.030 Ω/ft, so 350 mA would correspond to about 1 V loss for every 50 ft of wiring (100 ft including the both members of a pair), which is more length than would be used to connect luminaires to remote drivers in typical commercial installation. At 60 V, this allows a 20 W LED fixture to be powered over a single twisted pair. For higher power levels, more than one twisted pair can be used, or lower-gauge (thicker) wiring can be selected, still without resorting to conventional ac electrical power wiring, which is 12-gauge or 14-gauge for typical installations. The advantages of the use of low-voltage high-wire-gauge wiring will be immediately apparent to anyone familiar with the wiring that is typically used for standard fluorescent lighting fixtures. No conduits or other protective apparatus is required; the wire is much cheaper; and installation is much easier.

In accordance with one or more embodiments of the present invention, a remote driver 110 is provided capable of bidirectional communication with and providing power to a set of luminaires. The number of luminaires that can be connected to a single remote driver can vary to allow flexibility in installations of different geometries and sizes. For example, remote drivers with capacities ranging from 4-64 luminaires can be offered to accommodate installations ranging from a single small room to an entire commercial building floor. Even larger installations can be accommodated by using multiple remote drivers which further communicate with each other. It can be preferable to use multiple remote drivers in this way rather than single units with even larger capacity so that the low voltage wiring runs can be kept short, and the total length of wire required can be minimized.

Power to an LED-based luminaire can readily be controlled to adjust the level of illumination. DC current drivers are typically used. Light level can be adjusted by any means known in the art, for example, by current level adjustment, by pulse-width modulation of a fixed current level, or by a combination thereof. It is also possible to provide both bi-directional communication and power over the same wires by various methods such as those described in commonly owned co-pending U.S. patent application Ser. Nos. 12/389,868 and 12/465,800 which are incorporated herein by reference.

In accordance with one or more embodiments of the present invention, the measured signal at a sensor co-located with one luminaire resulting from the signal emitted from a signal source of another luminaire is converted into a "distance" measurement between the two luminaires. In the event that the measured signal at any sensor is saturated (i.e., the sensor output is at maximum), the intensity of the emitted signal can be reduced until no sensor output is saturated to ensure that relative distance measurements are meaningful. Such distance measurements can conveniently be calibrated to be linearly related to the physical distance between luminaires, but non-linear relationships can also be used. Such distance measurements are possible for both direct line-of-sight signal detection and reflected signal detection. Signal strength and distance calibration may vary according to which signal propagation path type dominates.

The identity of the emitting luminaire and receiving luminaire must be known. One way of making the emitter identity known is to encode the identity of the emitter into the signal. Another way of making the identity known is to cause only one luminaire to emit a signal at any given time, so that the timing of the signal identifies its source based on the I/O port of the remote driver to which each emitting luminaire is connected. Depending on the nature of the signal source, the distance measurement can be either a scalar (one-dimensional "range"; no direction information) or a vector (two-dimensional distance; typically range and angle in polar coordinates). Typical installations have coplanar luminaire mounting, and only two-dimensional fixture location is of interest, although three-dimensional measurement is also possible with appropriate sensor technology. Hereinafter, distance measurements will be described generically as "vectors" which may comprise one to three dimensions of measurement.

The precision and accuracy of both range measurements and angle measurements (if available) may vary and will determine the accuracy with which it is possible to map luminaire position onto, say, a floor plan corresponding to a particular system installation. In general, for the purpose of creating groups by auto-commissioning as described below, it is only necessary to achieve relative accuracy better than the minimum spacing between fixtures, and absolute scale calibration is not necessary unless mapping onto a floor plan is desired. However, should absolute scale calibration be desired, it is sufficient to manually identify the location of any pair of fixtures (and thus, the distance vector between the two fixtures, including spacing [range] and angular orientation). All remaining fixtures can then be mapped onto a floor plan based on the distance measurements obtained from sensor measurements.

As noted above, distances obtained using optical signal sources and sensors can use direct or reflected light or a combination thereof. For example, luminaires comprising a recessed light source as the sole signal source may be detected by sensors co-located with adjacent fixtures through predominantly reflected light. Other fixtures can have protruding light sources and/or additional protruding signal sources such as infrared LEDs. These protruding signal sources can send direct line-of-sight signals to sensors co-located with adjacent fixtures. Such direct signals can provide improved accuracy for the determination of distance vectors compared to determination based on reflected light, but reflected light can provide sufficient accuracy for typical areal illumination applications.

The distance measurement is performed using the signal source(s) in each luminaire plus the signal source(s) in any additional fixtures that are so equipped. A distance measurement is thereby obtained between each fixture with a signal source and every other fixture with a compatible detector in the lighting system. Certain isolated luminaires can be out of sensor range of all other luminaires (a single luminaire in a closet, for example), in which case, a distance measurement of "infinity" can be recorded.

In accordance with one or more embodiments of the present invention, non-luminaire fixtures such as standalone sensors and wall switches or other controls can also be equipped with signal sources and/or detectors, and if so equipped, distance measurements can be obtained for these fixtures as well. It is not necessary to use the same signal technology as is used for the luminaires; standalone sensors can be designed to use non-optical signal technology such as the ultrasonic or infrared sensor technology of a motion sensor. In certain embodiments, it is sufficient to identify the location of a wall switch with no added signal source or detector, for example, by manually toggling the switch and manually identifying the switch to the control system.

In accordance with one or more embodiments of the present invention, once a set of distance vectors have been obtained, these define one or more "graphs," where the fixtures are "nodes" or "vertices" of the graph, and the distance vectors are the edges that connect pairs of fixtures/nodes/vertices. For a set of co-planar fixtures, the graph is two-dimensional. Even for scalar distance measurements, any sub-graph with at least three vertices defines a "fixture triangle" which can be used to partially model the physical layout of the fixtures in the plane. If all fixtures are members of at least one such fixture triangle, then the graph fully models the physical layout of the entire set of fixtures.

Figure 2:
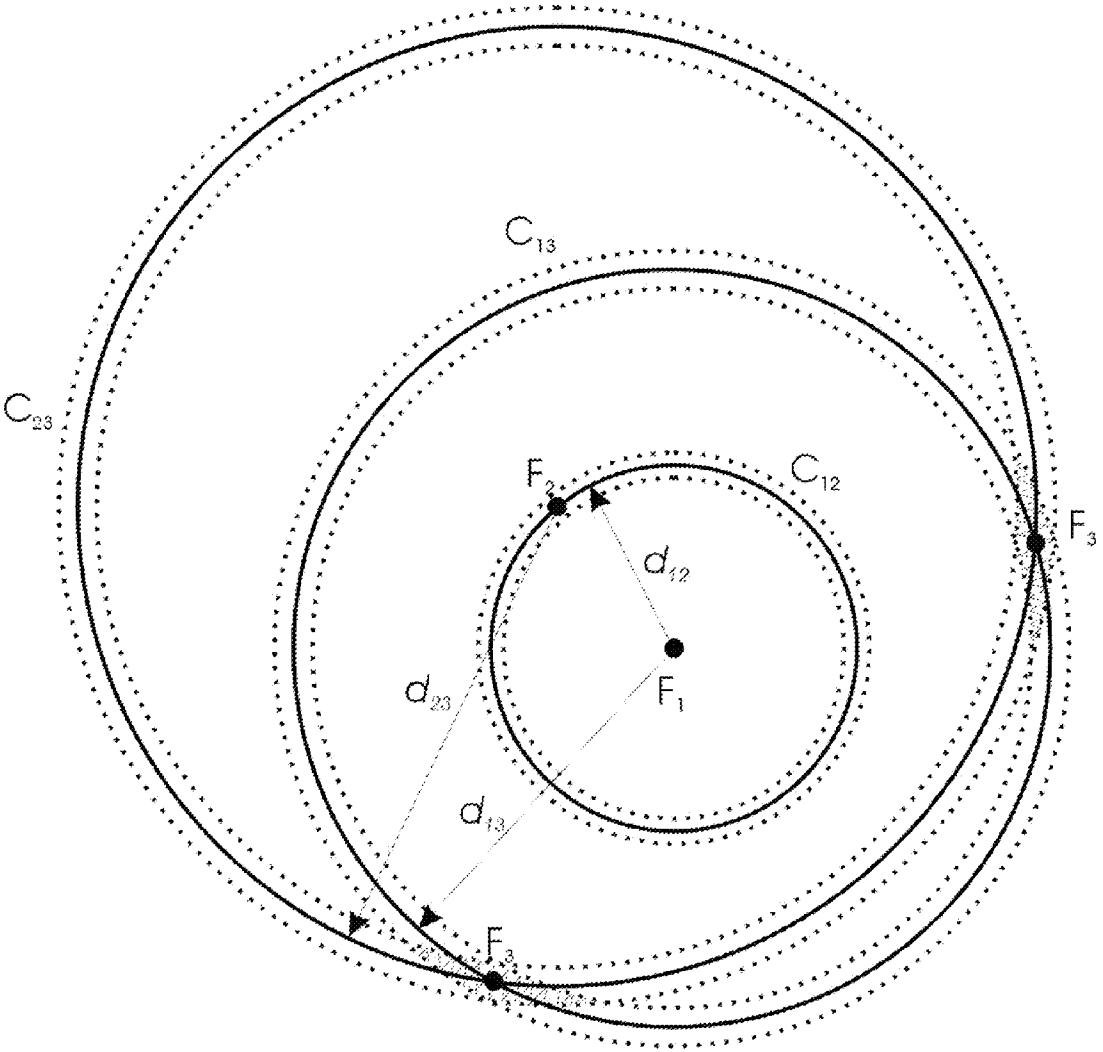
FIG. 2 shows an example of the creation of a fixture triangle from a set of distance vectors.

A fixture triangle can be created using "triangulation." An exemplary triangulation is illustrated in FIG. 2. A first fixture $F_1$ has a distance vector $d_{12}$ relative to a second fixture $F_2$. The location of fixture $F_2$ can fall on any point of the circle $C_{12}$ centered at the location of fixture $F_1$ with a radius of $d_{12}$. A third fixture $F_3$ has a distance vector $d_{13}$ relative to fixture $F_1$, and the location of fixture $F_3$ can fall on any point of the circle $C_{13}$ centered at the location of fixture $F_1$ with a radius of $d_{13}$. The fixture $F_2$ has a distance vector $d_{23}$ relative to fixture $F_3$. The vector $d_{23}$ can be used to limit the possible relative locations of $F_2$ and $F_3$ to those locations on the respective circles separated by the distance $d_{23}$. For example, a circle $C_{23}$ of radius $d_{23}$ can be drawn about any possible location of $F_2$, and the intersections of circles $C_{23}$ and $C_{13}$ would define two possible locations for $F_3$. The error in each distance measurement is illustrated by dotted tolerance bands for each circle. The shaded areas shown defined by the intersection of the tolerance bands for the circles $C_{23}$ and $C_{13}$ define an error region for the location of $F_3$. As additional distance measurements between other pairs of fixtures are added, the error regions can be reduced in size, and the multiple possible locations can typically be reduced in number, at least where four or more fixtures are close enough to allow distance vectors to be obtained.

In accordance with one or more embodiments of the present invention, "auto-commissioning" can then be performed, which is the process of assigning fixtures to "fixture groups." Such groups can be defined according to the needs of an installation. For a building divided by walls into relatively small rooms, a common way to assign groups is to simply identify all fixtures that are connected in a sub-graph and assign them to a "room group." All luminaires in that group could then be switched on and off together or dimmed together or configured to respond as a group to motion sensors or daylight sensors. For installations with larger rooms or large open spaces, it can be appropriate to define groups that are smaller than the entire contiguous space. For example, a group can be defined for the front and back sections of a conference room, or for different work areas in an open floor plan. For other applications, a group can be defined to cover an entire contiguous space, with an arbitrarily large number of fixtures. Depending on the application, a variety of algorithms can be used to define groups. Groups may be defined such that each fixture is assigned to a single group, or alternatively, single fixtures can be assigned to two or more groups. Such overlapping groups can allow for special control effects such as "orbing" which will be describe in detail below.

Figure 3:
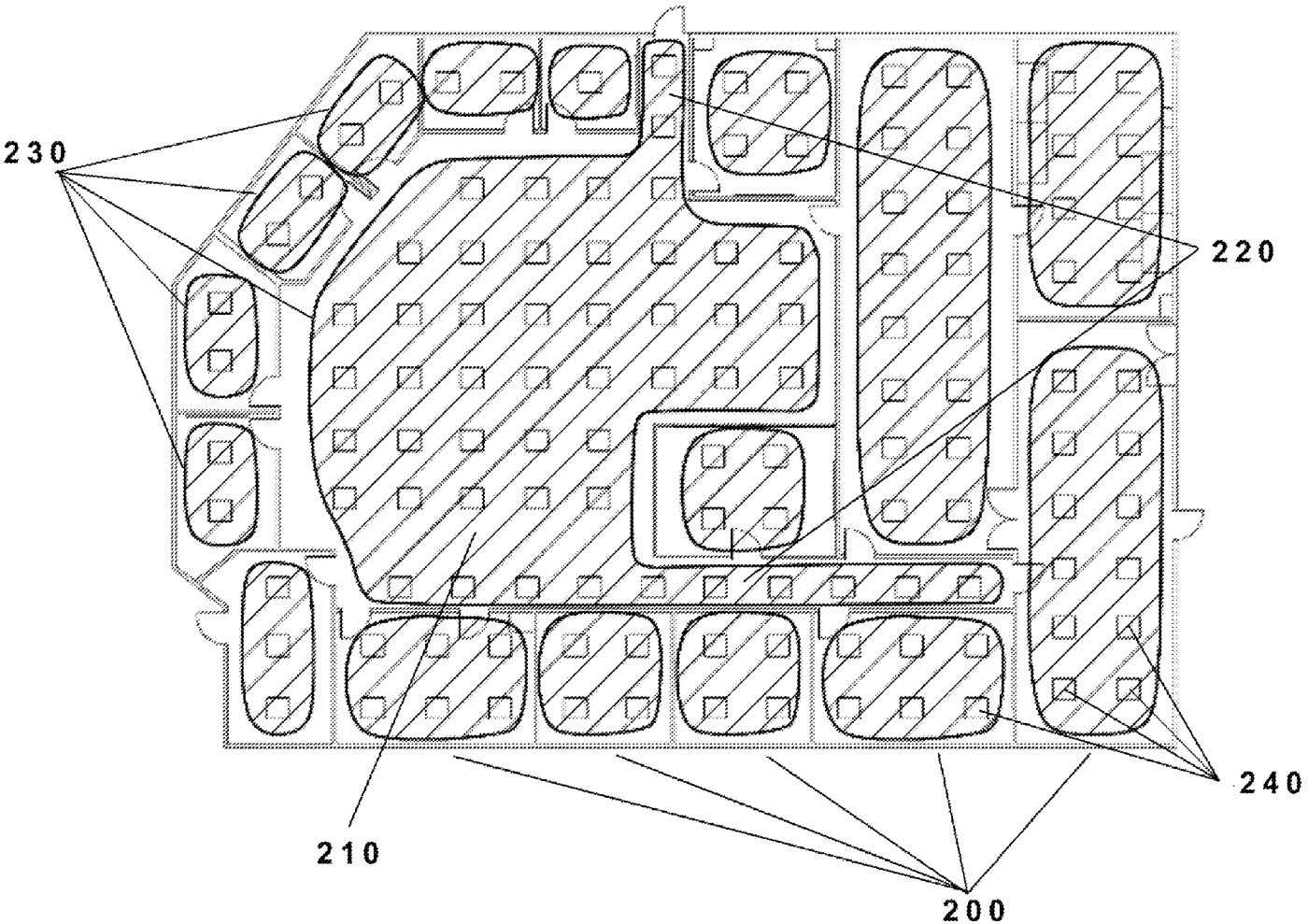
FIG. 3 shows a possible division into groups of luminaires overlaid on a building floor plan after auto-commissioning according to one embodiment of the present invention.

An example of non-overlapping groups created by auto-commissioning is illustrated in FIG. 3, which shows luminaires and fixture groups superimposed on a building floor plan. In this example, the floor plan comprises a number of discrete rooms 200 of varying size, a larger open area 210, and two hallways 220. Auto-commissioning creates room groups 230, which, in the example of FIG. 3, comprise 1-16 luminaires 240 according to the size of the room and the number of installed luminaires. In general, any number of luminaires per room is possible. The larger open area 210 and hallways 220 are combined into a single group by using an auto-commissioning algorithm which groups luminaires in the same group as long as each detector can receive a signal from at least one member of the group.

The auto-commissioning process can be repeated whenever the physical state of the installation has changed. Such changes might be due to the installation, removal, or relocation of fixtures in the system, or they might be due to other physical changes to the environment such as the addition or removal of walls or partitions, or the reallocation of workspace areas to different uses. A second or subsequent auto-commissioning can preserve existing distance vectors, replace them, or supplement them. Existing groups can be preserved; new groups can be created; new fixtures can be assigned to existing groups; fixtures and groups can be deleted; alternate groupings can be added to define overlapping groups that did not previously exist. Similarly, it is also possible to run the auto-commissioning process on only a subset of fixtures where changes are known to have occurred.

Once a lighting system has been commissioned and groups of fixtures have been defined, it is possible to implement a variety of lighting effects, some examples of which will now be presented. Some will be immediately apparent to anyone familiar with area lighting. For example, groups of luminaires can be controlled by a group switch or dimmer, and they can be programmed to respond to time-of-day programming, motion sensors, daylight sensors and the like as if they were a single luminaire.

In accordance with one or more embodiments of the present invention, rather than setting all light levels for luminaires in a group to the same level, the levels can be adjusted to provide approximately constant illumination independent of the distribution and number of luminaires, and independent of any variations in auxiliary sources of light such as sunlight through a window or other light sources not part of the lighting system. In this embodiment, it can be convenient to define a group centered on a particular central luminaire and to identify all other luminaires in the group as peripheral luminaires. The light level of the central luminaire can be set to a predefined level such as full power or 70% of full power. Its built-in light sensor is used to detect the returned light intensity, and the peripheral luminaires (all of the remaining luminaires in the group) can then be set to whatever level is needed to provide the same illumination level as defined by the measured light return detected by each luminaire sensor. In this way, the level of each luminaire is turned down in response to light from its neighbors and in response to any variations in the reflectivity of the local area to provide the most uniform possible illumination given the available luminaires. If the central luminaire is first turned on alone to measure a reference return light intensity, once this desired intensity is determined, then its light level can also be adjusted (reduced) in response to light received from adjacent luminaires once they are turned on as well so that the return light intensity detected by the central luminaires also remains constant. Note that this control process provides automatic response to the changing reflectivity of the illuminated area as persons and objects move or are relocated; to any changes, aging effects, or failures of individual luminaires; as well as to changing light from any source outside the lighting system such as sunlight coming through windows.

In accordance with one or more embodiments of the present invention, it is also possible to define an "orb region" or movable lighting area. This area can be of any convenient two-dimensional shape, but is typically approximately rectangular or elliptical (square or circular, if symmetric). An orb region can be defined with dimensions large enough to contain a plurality of luminaires including one or more "central" luminaires and at least one set of neighboring luminaires surrounding the central luminaires. An orb region can be viewed as one of a set of overlapping groups in the sense described above, but it is not necessary to create a table listing the fixtures associated with every possible orb region. Rather, the members of a particular orb region can be determined on-the-fly as particular lighting effects are implemented. An orb region is not fixed relative to a floor plan and its associated luminaires, and may move with respect to the floor plan, for example, in response to the detection of motion by motion sensors. A lighting effect called "orbing" can be created by defining a light level which varies in intensity according to a defined mathematical function from the center of an orb region to its perimeter. "Light level" can be defined either in terms of the drive current or pulse width provided to the light source in each luminaire, or in terms of the received signal intensity at the light sensor co-located with each luminaire. Depending on the desired effect, the light intensity at the center may be either greater or less than that at the perimeter. For example, a greater center intensity is useful to follow motion of a person in an otherwise unoccupied area; a lower center intensity can be set at a Computer-Aided Drawing (CAD) work area in the middle of an active workspace. The location (center and orientation if asymmetric) of an orb region can be defined relative to an installation floor plan with fixtures mapped thereto by the auto-commissioning process described above. The center and orientation of an orb region can, but need not, coincide with a fixture location, and they may move with time relative to the floor plan. The light level for any luminaire contained within the orb region may be calculated and set based on its position in the orb region.

Figure 4:
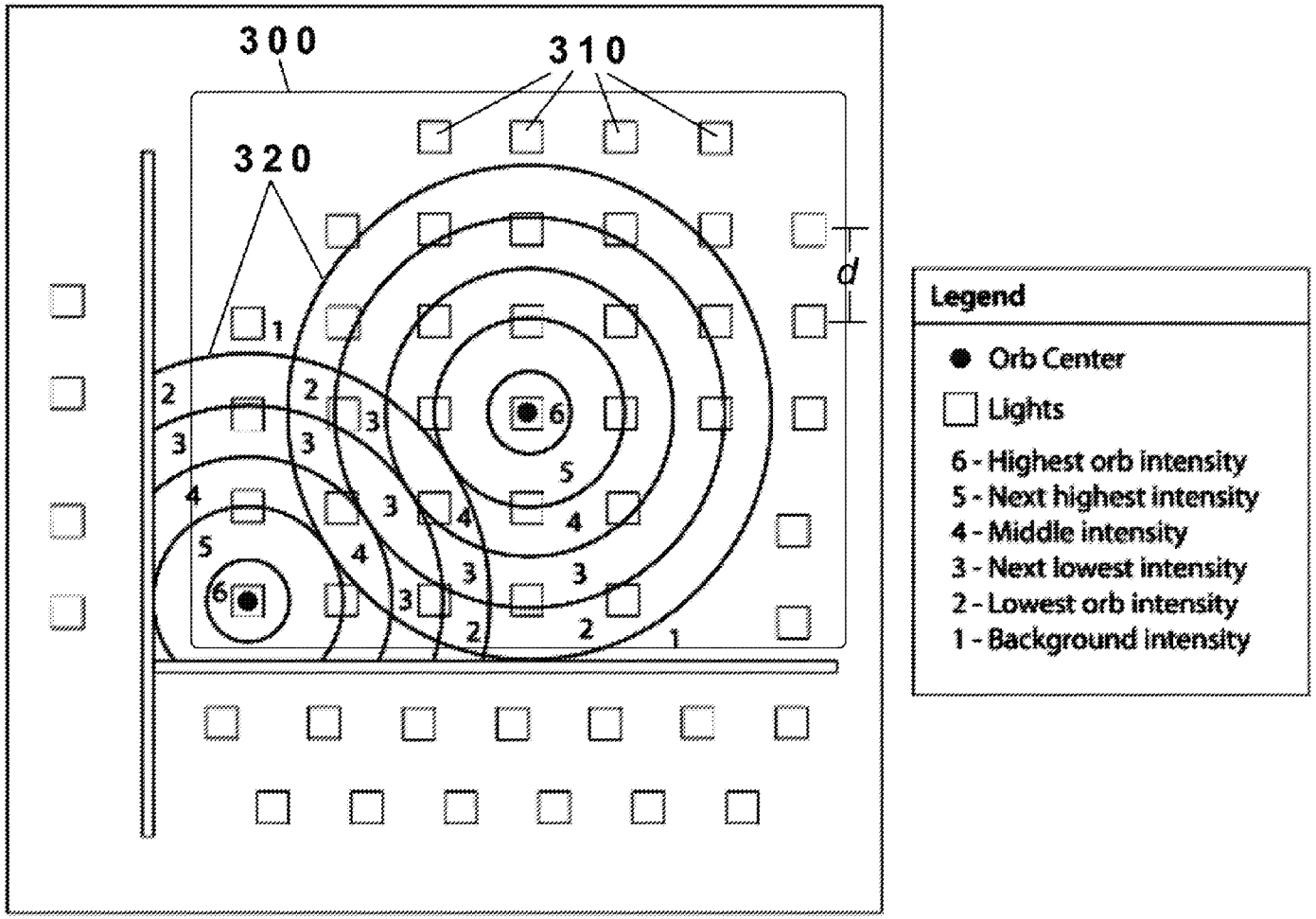
FIG. 4 shows an example of the use of movable orb regions to set variable light levels within portions of a group according to one embodiment of the present invention.

An example of light intensity setting for a circular orb region is shown in FIG. 4. A group 300 is defined to include all the luminaires in a room. A circular orb region 320 is shown at two possible locations. In one location which includes 20 luminaires, the orb is centered directly on a luminaire away from the walls. A square grid of luminaires 310 is shown, and the orb region 320 has a radius of approximately 2.6 d, where d is the spacing between luminaires. Luminaires outside the orb region are set to a background level 1. The orb region 320 is divided into concentric rings 322-326 of width approximately 0.5 d. Luminaires located in each ring within the orb (and also within the group 300) are set at levels varying from highest in the center (6), decreasing to the background intensity 1. The orb region is shown at two locations centered on two different luminaires. However, the orb center can move freely and can be instantaneously centered at any location between luminaires as well as directly on a luminaire. Note that when the center of the orb region 320 is located at the second location near a wall, the orb region is effectively truncated at the wall; luminaires located in the orb region but outside the group 300 (i.e., outside the room, for example, in an adjacent room) do not have their light levels adjusted.

In accordance with one or more embodiments of the present invention, orbing can be used to limit illumination to orb regions with activity identified by available sensors such as motion sensors. Orb regions with no activity can be set for low or zero illumination, and regions with activity can receive a preset "normal illumination level" (defined according to the illumination needs of that work location or activity). Orb regions can move with detected activity, so that illumination follows movement through a room or along a hallway or stairway. Orb regions related to independent activity can overlap, and the light levels in the overlap region can be set based on an overlap function combining the defined functions for each orb region. Additional sensor and time information can also be incorporated into algorithms used to determine the light level of each luminaire in an orb region. For example, the "normal illumination level" for a given work location can be defined to respond to time-of-day or daylight sensor information.

In accordance with one or more embodiments of the present invention, time constants can also be used to determine how rapidly any luminaire light level is increased or decreased. These can be set differently for increase and decrease, if desired. For example, it might be desired that light comes up rapidly whenever motion is newly detected, but decays slowly once no further motion is detected. Slow changes with time constants of about 30 seconds or more also can be useful to avoid distracting building users with sudden changes in lighting, whether in their immediate vicinity or somewhere in their peripheral vision.

In accordance with one or more embodiments of the present invention, a lighting system comprising one or more interconnected remote drivers and their associated luminaires, sensors, and controls further comprises a user interface with a graphical display device. The graphical display device can be used to display architectural drawings such as a reflective ceiling plan or floor plan with the fixture map created by auto-commissioning superimposed thereon. Fixtures that have indeterminate locations due to limited or inaccurate available sensor data may have their placement uncertainly depicted visually through animation effects or other visual indication. Some tentative fixture groups and orb regions can be automatically determined by the auto-commissioning software, and the user interface can allow editing of these group and orb region assignments and definition of additional groups and orb regions as desired to suit the needs of the installation. The user interface can further provide an interactive means to define control functions for the fixture groups and orb regions.

It will be understood that the descriptions of one or more embodiments of the present invention do not limit the various alternative, modified and equivalent embodiments which may be included within the spirit and scope of the present invention as defined by the appended claims. Furthermore, in the detailed description above, numerous specific details are set forth to provide an understanding of various embodiments of the present invention. However, one or more embodiments of the present invention may be practiced without these specific details. In other instances, well known methods, procedures, and components have not been described in detail so as not to unnecessarily obscure aspects of the present embodiments.

What is claimed is:

1. A method of commissioning a lighting system, the method comprising:

providing a plurality of fixtures, the fixtures comprising a plurality of luminaires;

providing a plurality of sensors and a plurality of signal sources, wherein each one of the sensors and each one of the signal sources is co-located with a respective one of the fixtures in the lighting system;

causing a respective one of the signal sources to emit a signal;

detecting the signal at a respective one of the sensors;

converting the signal detected by the respective one of the sensors into a measurement of a distance between the fixture that is co-located with the respective one of the signal sources that emitted the signal and the fixture that is co-located with the respective one of the sensors that detected the signal; and creating a fixture map based on the distance between the fixtures.

2. The method of claim 1, further comprising assigning the fixtures to a plurality of groups based on relative locations of the fixtures in the fixture map.

3. The method of claim 2, further comprising controlling any light sources in the fixtures assigned to one group together as a group.

4. The method of claim 2, further comprising:

measuring a reference light intensity detected by one of a plurality of light sensors included in the sensors, wherein the one of the light sensors is located at a center of one of the groups; and adjusting a light level of any light source in the fixtures that are in the one of the groups so that each of the light sensors co-located with the fixtures that are in the one of the groups measures light at the reference light intensity.

5. The method of claim 1, further comprising overlaying a movable orb region on the fixture map, and determining a location of the luminaires within the movable orb region.

6. The method of claim 5, further comprising setting a light level of each light source in the luminaires located within the orb region such that the light level in the orb region decreases from a center to a periphery of the orb region.

7. The method of claim 5, further comprising setting a light level of each light source in the luminaires located within the orb region such that the light level increases from a center of the orb region to a periphery of the orb region.

8. The method of claim 5, further comprising setting a light level of each light source in the luminaires located within the orb region by setting a drive current, voltage, or pulse width provided to the luminaires so that the signal detected by the respective one of the sensors co-located with each one of the luminaires within the orb region decreases as a distance of each one of the sensors from a center of the orb region increases.

9. The method of claim 5, wherein each light source in the luminaires located within the orb region is set to a light level that varies according to a predefined mathematical function of a location of each light source within the orb region.

10. A method of commissioning a lighting system comprising:

installing a plurality of luminaires, a plurality of light sensors, and a plurality of light sources such that each one of the light sensors and each one of the light sources is co-located with a respective one of the luminaires;

causing a respective one of the light sources to emit a signal;

detecting the signal with a respective one of the light sensors;

converting the signal detected by the respective one of the light sensors into a distance measurement between the respective one of the luminaires co-located with the respective one of the signal sources that emitted the signal and the respective one of luminaires co-located with the respective one of the light sensors that detected the signal;

creating a map of a location of the luminaires based on the distance measurement between the luminaires; and assigning each one of the luminaires to a group of the luminaires based on the location of each of the luminaires in the map.

11. A system for commissioning a lighting system, the system comprising:

a plurality of sensors;

a plurality of signal sources, wherein each one of the signal sources and each one of the sensors is co-located with a respective one of a plurality of fixtures in the lighting system, the fixtures comprising a plurality of luminaires; and a remote driver configured to:

cause a respective one of the signal sources to emit a signal;

receive an output of a respective one of the sensors that detected the signal;

convert the output of the respective one of the sensors into a measurement of a distance between the fixture that is co-located with the respective one of the signal sources that emitted the signal and the fixture that is co-located with the respective one of the sensors that detected the signal; and create a fixture map based on the distance between the fixtures.

12. The system of claim 11, wherein the signal sources are included in the fixtures.

13. The system of claim 12, wherein each one of the signal sources comprises a respective primary light source of the respective one of the luminaires, the signal is a light signal, and the sensors comprise a plurality of optical sensors.

14. The system of claim 11, wherein the sensors are included in the fixtures.

15. The system of claim 11, wherein the fixtures comprise control devices.

16. The system of claim 11, further comprising a plurality of wires, wherein each one of the wires electrically couples the remote driver to a corresponding one of the fixtures, to a corresponding one of the signal sources, and to a corresponding one of the signal sources, and wherein the remote driver provides power and communicates over each of the wires.

17. A system for commissioning a lighting system comprising:

a remote driver comprising a plurality of ports, wherein each one of the ports is configured to connect to a respective one of a plurality of luminaires over a respective wire, and wherein the remote driver is configured to:

communicate with each one of a plurality of sensors over the respective wire, wherein each one of the sensors is co-located with the respective one of the luminaires;

cause a respective one of a plurality of signal sources to emit a signal, wherein each one of the signal sources is co-located with the respective one of the luminaires;

receive, over the respective wire, an output of a respective one of the sensors that detected the signal;

convert the signal detected by the respective one of the light sensors into a distance measurement between the respective one of the luminaires co-located with the respective one of the signal sources that emitted the signal and the respective one of luminaires co-located with the respective one of the light sensors that detected the signal;

create a map of a location of the luminaires based on the distance measurement between the luminaires.

* * * * *